US008245654B2

(12) United States Patent
Konig et al.

(10) Patent No.: US 8,245,654 B2
(45) Date of Patent: Aug. 21, 2012

(54) EMBROIDERY HOOP

(75) Inventors: Michael Konig, Constance (DE); Frank Prufer, Hilzingen (DE); Markus Muller, Fruthwilen (CH)

(73) Assignee: BERNINA International AG, Steckborn (CH)

( * ) Notice: Subject to any disclaimer, the term of this patent is extended or adjusted under 35 U.S.C. 154(b) by 78 days.

(21) Appl. No.: 12/813,816

(22) Filed: Jun. 11, 2010

(65) Prior Publication Data

US 2010/0313804 A1 Dec. 16, 2010

(30) Foreign Application Priority Data

Jun. 12, 2009 (CH) ..... 915/09

(51) Int. Cl.
*D05C 9/04* (2006.01)

(52) U.S. Cl. ..... 112/103

(58) Field of Classification Search ..... 112/103, 112/76, 78, 470.14, 470.18; 38/102, 102.2, 38/102.7

See application file for complete search history.

(56) References Cited

U.S. PATENT DOCUMENTS 3,405,670 A * 10/1968 Scholl et al. ..... 112/470.09
3,664,288 A * 5/1972 Weidlin Von Boden et al. ..... 112/103
5,884,571 A * 3/1999 Valadez et al. ..... 112/103
5,970,895 A * 10/1999 Mack ..... 112/103

* cited by examiner

*Primary Examiner* — Tejash Patel
(74) *Attorney, Agent, or Firm* — Volpe and Koenig, P.C.

(57) ABSTRACT

An embroidery hoop (1) for a sewing machine or embroidery machine having two hoop parts, namely the lower hoop part (3) and the upper hoop part (5). The two hoop parts (3, 5) are connected to each other by a hinge that can be released without the use of tools. The embroidery material is clamped between the inner hinge element (9) on the lower hoop part (3) and the outer hinge element (15) on the upper hoop part (5). Through this measure, an embroidery material can be embroidered at any position.

10 Claims, 7 Drawing Sheets

EMBROIDERY HOOP

CROSS-REFERENCE TO RELATED APPLICATIONS

This application claims the benefit of Swiss Patent Application No. 00915/09, filed Jun. 12, 2009, which is incorporated herein by reference as if fully set forth.

BACKGROUND

The invention relates to an embroidery hoop for a sewing or embroidery machine.

Embroidery hoops are needed to keep at least one area of an embroidery material in tension and to guide this material by via a suitable drive under the needle of a sewing or embroidery machine. Such embroidery machines have been known for a long time in many constructions. In order to keep the embroidery material or the area of embroidery material in tension as optimally as possible, an embroidery hoop is known that has a lower part that is connected to a drive device of the embroidery or sewing machine and an upper part that can be connected by fasteners or by a tensioning device to the lower part, in order to clamp the embroidery material in-between. Alternatively, the upper part could also be connected to the drive device. In order to obtain the best possible clamping on all sides, the upper hoop part engages partially into the open cross section of the lower part and in this way clamps the embroidery material.

The tensioning and later shifting of the embroidery material, in order to be able to attach an embroidery pattern across a larger surface area is complicated.

Furthermore, embroidery hoops are known in which the lower hoop part that is connected to the drive device of the sewing and embroidery machine and the upper hoop part are connected to each other by a hinge. Such embroidery hoops are very simple in operation, because after laying the embroidery material on the lower hoop part, the upper part is placed by a pivoting motion exactly over the lower hoop part and can be connected to this lower part. A disadvantage in this hoop arrangement is the fact that the embroidery material can be embroidered only along its edge, because only a narrow strip can be clamped tight on one side, namely on the side of the hinge. Thus, the center of the embroidery material cannot be embroidered if this is larger than approximately four-times the cross-sectional surface area of the embroidery hoop itself.

SUMMARY

One objective of the present invention is to provide an embroidery hoop that combines the advantages of both embroidery hoop constructions and that allows embroidering both along the edge of an embroidery material and also in its center. In other words, embroidery fabric layers of any size, such as tablecloths, bath towels, articles of clothing, etc., can be embroidered on a household sewing machine. Another advantage of the invention is that the embroidery hoop is easy to handle and also can be produced economically.

BRIEF DESCRIPTION OF THE DRAWINGS

The invention is explained in detail with reference to an illustrated embodiment. Shown are

DETAILED DESCRIPTION OF THE PREFERRED EMBODIMENTS

Figure 1:
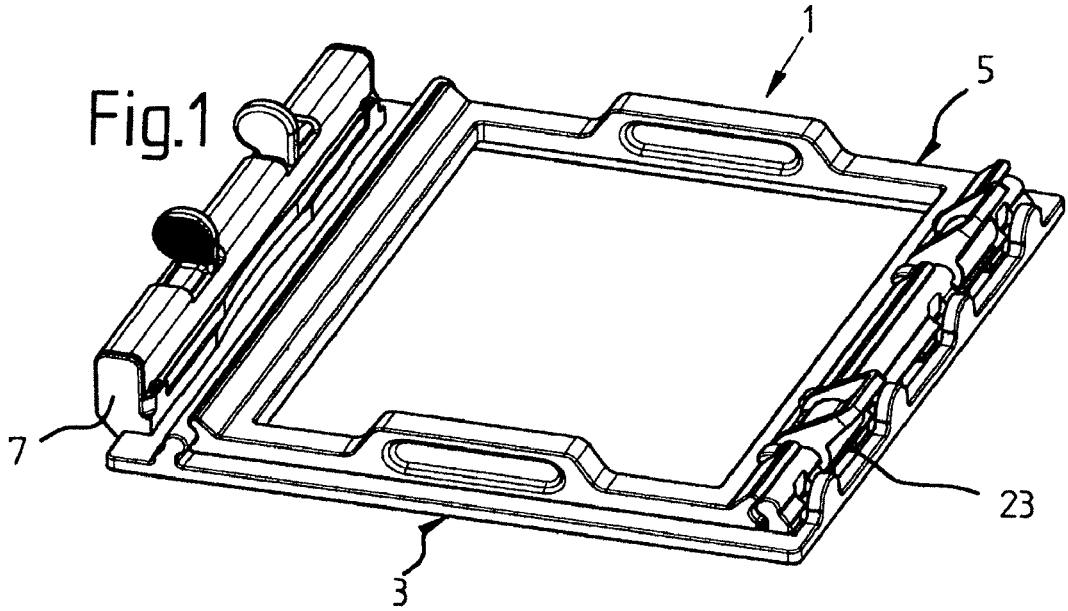
FIG. 1 is a perspective top view onto an embroidery hoop in a closed state.
Figure 2:
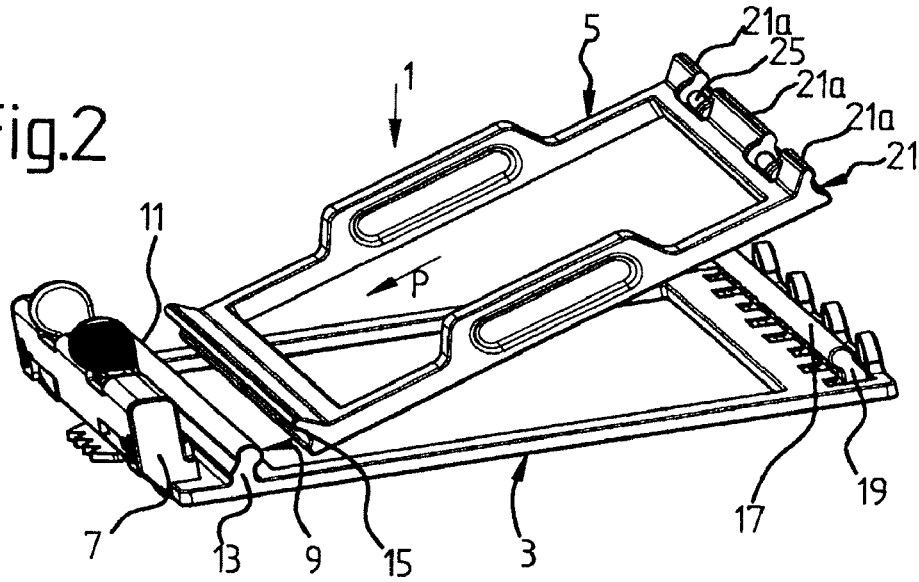
FIG. 2 is a perspective top view of the upper hoop part onto the lower hoop part.
Figure 3:
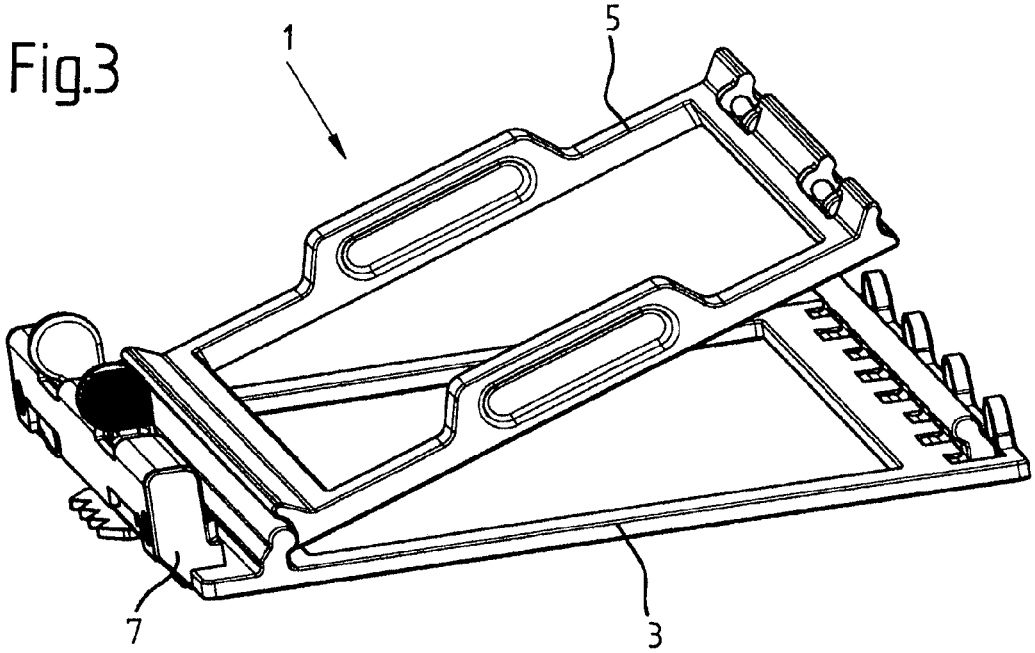
FIG. 3 is a perspective top view of the embroidery hoop with upper hoop part docked on the lower hoop part.
Figure 4:
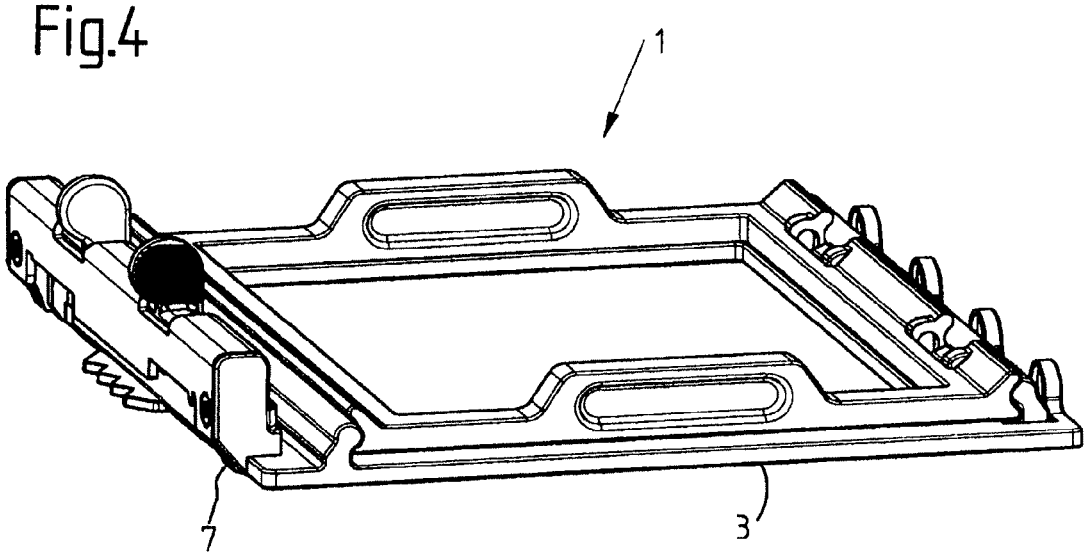
FIG. 4 is an additional view of the assembled embroidery hoop.
Figure 5:
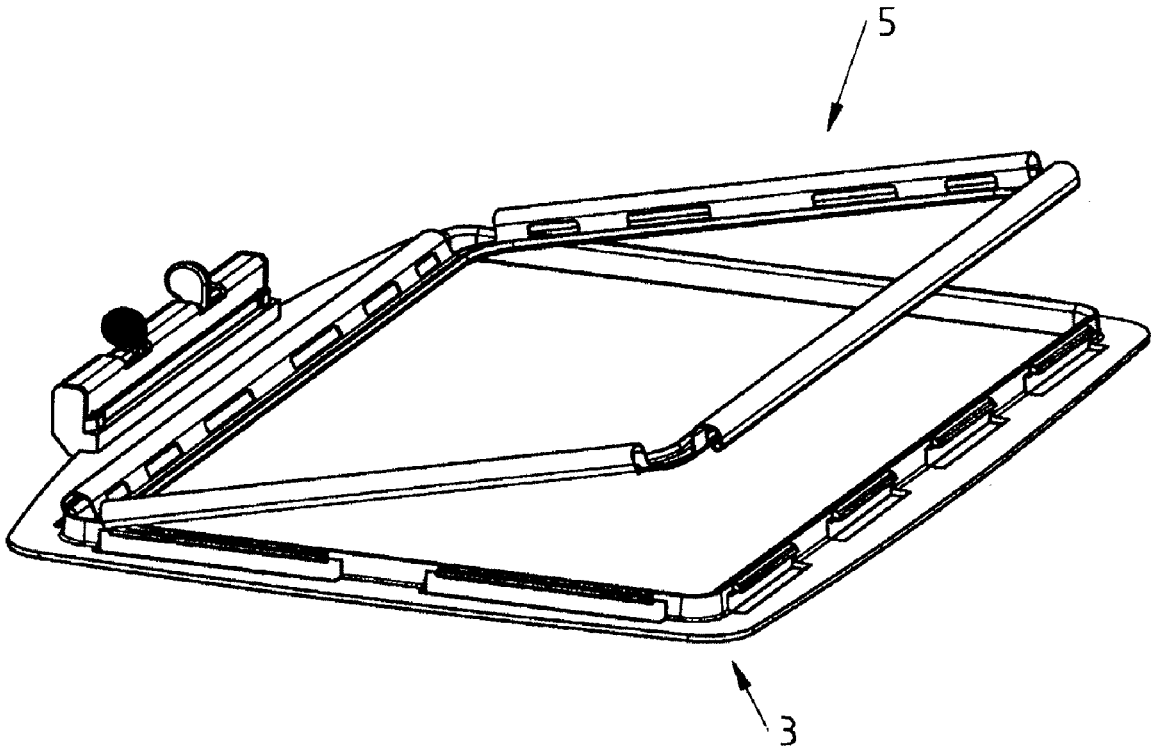
FIG. 5 is a perspective view of an additional embodiment of an embroidery hoop.
Figure 6:
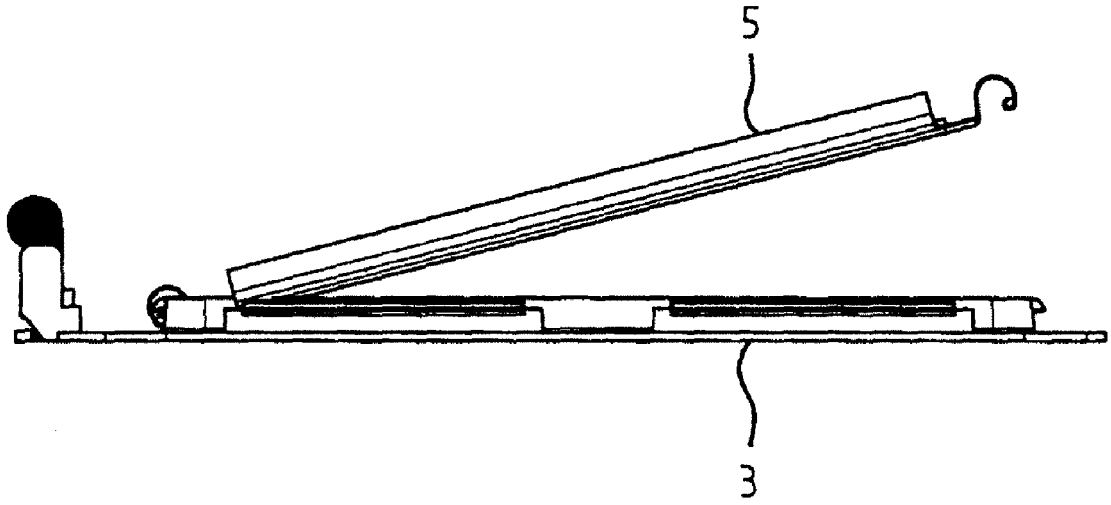
FIG. 6 is a cross-sectional view through the embroidery hoop according to FIG. 5, half opened.
Figure 7:
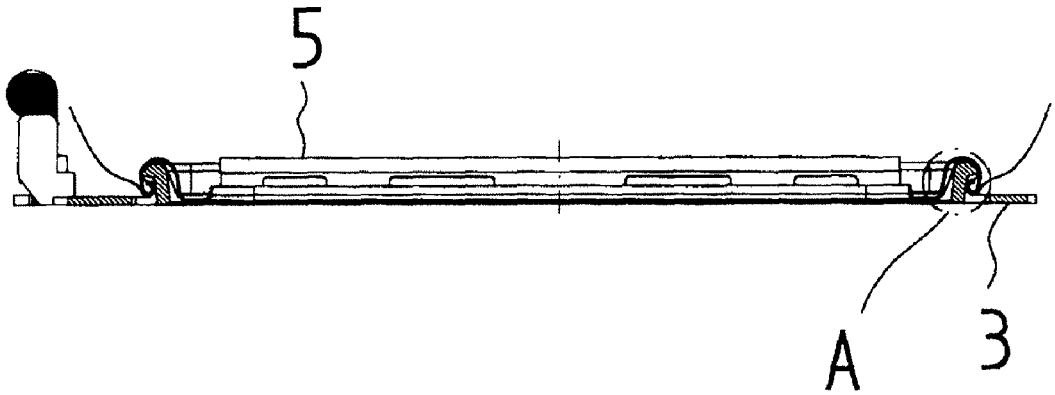
FIG. 7 is a cross-sectional view through the embroidery hoop according to FIG. 5, closed and with inlaid embroidery material.

In the figures, an embroidery hoop is designated with reference symbol 1. This comprises a lower hoop part 3 and an upper hoop part 5. A coupling element 7 that is designed to couple the embroidery hoop 1 to a not-shown drive part of a sewing or embroidery machine is arranged on the lower hoop part, in the figures on the left side. The coupling parts of the shown type are known, for example, from EP 1 270 788. Obviously, a different coupling device could also be provided.

Furthermore, an inner hinge element 9 is constructed on the lower hoop part 3, advantageously in the region of the coupling element 7. In the shown example, this comprises a cylindrical rod 11 that is connected to the surface of the lower hoop part 3 at a distance by a web 13. The thickness of the web 13 is significantly smaller than the diameter of the cylindrical rod 11. Advantageously, the web 13 lies at an acute angle to the surface of the lower hoop part 3 and the rod 11 projects against the embroidery opening in the lower hoop part 3.

On the upper hoop part 5, an outer hinge element 15 is constructed that has the shape of a hollow cylindrical section. Advantageously, the outer hinge element 15 extends across an angle of 180° to 230°. The inner radius of the circular cylinder section on the outer hinge element 15 is equal to or advantageously somewhat greater than the radius of the cylindrical rod 11 on the inner hinge element 9, in order to be able to hold in-between embroidery fabric layers (material) of different thicknesses and character.

On the side of the lower hoop part 3 opposite the coupling element 7 and the inner hinge element 9 there is an additional cylindrical rod 17. This is advantageously connected to the lower hoop part 3 in an articulated and spring-mounted way by a web 19.

The end face of the outer edge opposite the outer hinge element 15 has a concave construction on the upper hoop part 5. The concave region extends across ca. 100°-120°. Advantageously, the concave region of the outer edge is divided into several sections 21*a*. Between the sections 21*a*, there can be openings in which latch elements 23 (fasteners) can be inserted (compare FIG. 1). The latch elements 23 are connected to the outer edge 21 in an articulated fashion. Pegs (not visible) that engage in boreholes 25 on the edge regions 21*a* are used as hinge bodies.

Alternatively, the hinge axis or shaft formed by the rod 11 could also be constructed on the upper hoop part 5 and the hinge socket, i.e., the outer hinge element 15, could be constructed on the lower hoop part 3.

On parallel, opposing surfaces of the lower hoop part 3 and the upper hoop part 5 when the embroidery hoop 1 is closed, there are friction-increasing elements between the hoop parts 3, 5 and embroidery material tensioned in-between (embroidery material not shown). Such elements can be: a rough surface or a coating with a rubber-like material, such as, foam rubber or silicone, etc.

In order to tension embroidery material between the lower hoop part 3 and the upper hoop part 5, this is placed loosely on the lower hoop part 3, wherein the region to be embroidered is positioned above the window in the lower hoop part 3. Then the upper hoop part 5 is guided with its outer hinge element 15 onto the inner hinge element 9 on the lower hoop part 3 and, if the outer hinge element 15 comprises an angle of greater than 180°, clips onto the inner hinge part 9 in the direction of the arrow P. Then the outer hoop part 5 is pivoted/folded down and its concave outer edge 21 is led into contact with the cylindrical rod 17 on the lower hoop part 3. Through further downward pivoting of the upper hoop part 5, the cylindrical rod 17 also pivots and clamps the embroidery material (not shown) between the surface of the cylindrical rod 17 and the concave outer edge 21. For the mutual locking (securing of the closed position), the at least one latch element 23 is pivoted into a latch position.

In an additional construction of the invention according to FIGS. 5 to 8, the upper hoop part 5 comprises at a plate, advantageously, a spring plate 27, with an essentially c-shaped cross section at least along each straight-line hoop section. The spring plate has, on one longitudinal edge and essentially at a right angle to the c-shaped section 29, a flat section 31 that presses the embroidery material downward when the embroidery material 33 is in tension. Then a web 35 that extends upward, i.e., essentially at a right angle to the flat section 31 and that increases the strength of the spring plate 27 can be provided on the flat section 31.

Figure 8:
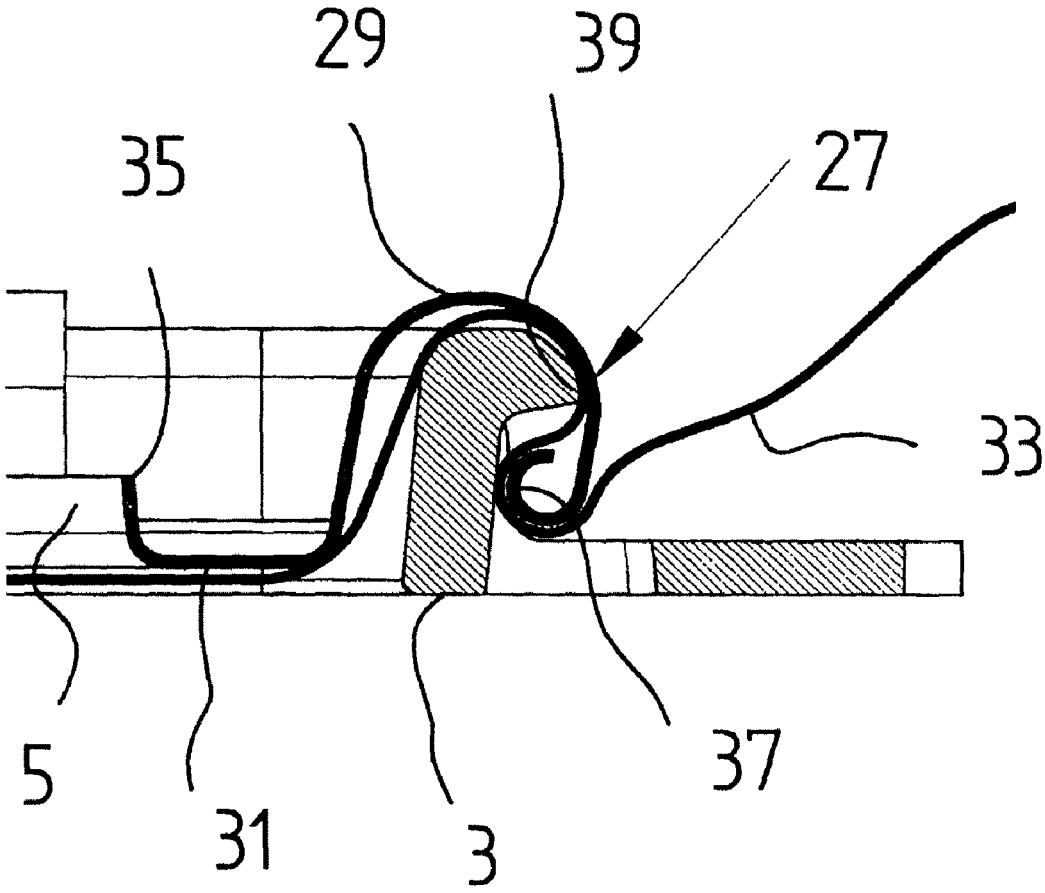
FIG. 8 is an enlarged view according to the area indicated at A in FIG. 7.

On the free end of the spring plate 27 or the c-shaped section 29, a rolled flange 37 is constructed that is used to latch the spring plate 27 with the latch tab 39 on the lower hoop part 3. Alternatively, the rolled flange 37, not as shown in FIG. 8, could be bent toward the center of the upper hoop part, but instead could be rolled outward as in the construction according to FIG. 9. In this construction of the rolled flange 37, the c-shaped section 29 is bent farther inward, in order to be able to latch together with the rolled flange 37 on the latch tab 39 and the engage behind the latch tab 39.

The spring plate 27 or its four legs could be connected to each other at the corners, for example, by plastic elements or a plastic hoop or metal hoop, etc., could be provided to which the four straight-line legs of the spring plate 27 are attached. In the shown embodiment, the spring plate 27 is produced in one piece and in the region of the four corners, no c-shaped sections 29 are constructed or the spring plate 27 is notched at these positions.

The joining of the lower hoop part 3 and upper hoop part 5 during the clamping of the embroidery material 33 is realized as described below. As in the first embodiment, the embroidery material is placed loosely, but oriented cleanly and pulled flat, on the lower hoop part 3. Then the operating person presses one of the four legs of the spring plate 27 over the underlying latch tab 39. Through this contact pressure, first an edge of the embroidery material 33 is held tight. The upper hoop part 5 still lying at an acute angle to the lower hoop part 3 can now be pivoted downward like in the first embodiment. Here, the first latch tab 39 forms a hinge with the first section of the spring plate 27 placed on of this tab. When the upper hoop part 5 is pivoted downward, the embroidery material 33 is likewise clamped successively onto the two lateral sections of the spring plate 27 and simultaneously tensioned to the hoop sections (cf. FIG. 9, left side). Finally, the spring plate section opposite the first spring plate section used as a hinge meets the underlying latch tab 39 and is latched by pressure from above with this tab and the rolled flange 37 grips behind the latch tab 39 and holds the embroidery material tensioned in-between tight. The embroidery hoop is opened in the reverse sequence of the individual steps. The opening and closing of the embroidery hoop can be started at any edge.

Figure 9:
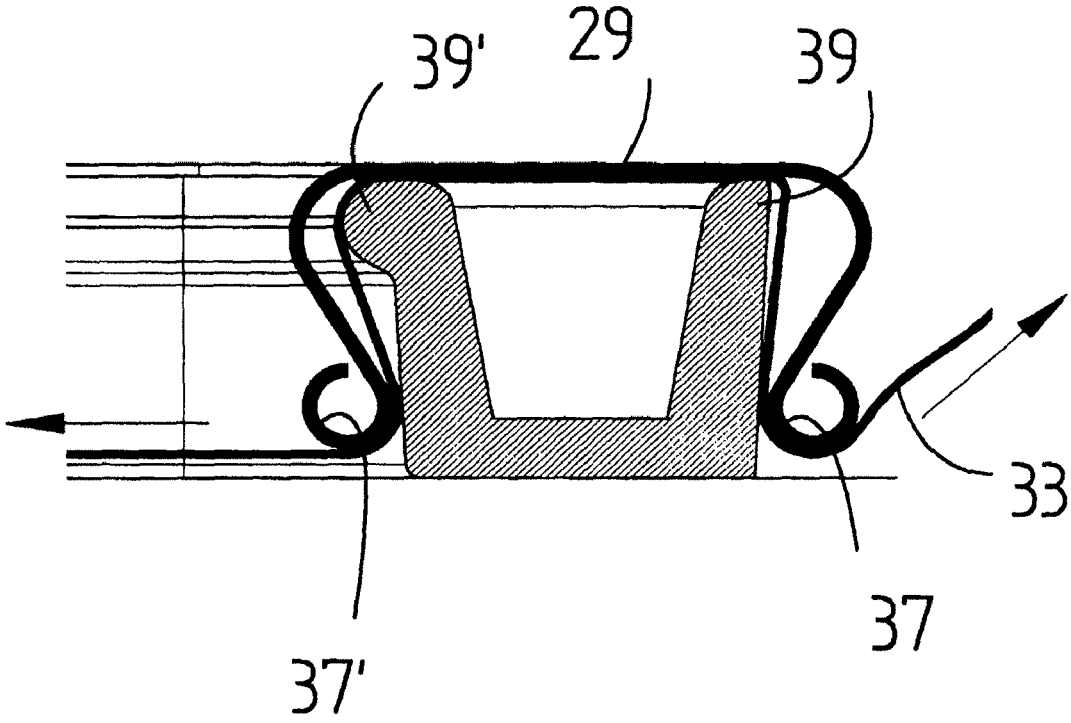
FIG. 9 is a detail view as in FIG. 8, but in an additional construction of the invention.

In the construction of the invention according to FIG. 9, the spring plate 27 encompasses not only a latch tab 39 directed outward and constructed on the lower hoop part 3, but instead two u-shaped or v-shaped latch tabs 39 and 39' are constructed on the lower hoop part 3. Therefore it is possible to greatly deflect and simultaneously tension the embroidery material 33 twice with a correspondingly shaped upper hoop part 5 having two parallel rolled flanges 37 and 37'.

In order to simplify the opening, i.e., lifting, of the upper hoop part 5 from the lower hoop part 3, the latch tab 39 could be constructed without a bead 39'. This measure, i.e., the asymmetric construction of the lower hoop part 3, allows, as described, a simplified opening or lifting of the upper hoop part 5 and, on the other hand, it can be achieved by the latch tab 39' that at this position, i.e., in the region of the embroidery material 33 to be tensioned, the latter is pulled down onto the lower hoop part 3 and, on the other hand, the tensioned embroidery material 33 does not force the upper hoop part 5 upward.

LEGEND

1 Embroidery hoop
3 Lower hoop part
5 Upper hoop part
7 Coupling element
9 Inner hinge element
11 Cylindrical rod
13 Web
15 Outer hinge element
17 Cylindrical rod
19 Web
21 Outer edge
23 Latch element
25 Borehole
27 Spring plate
29 c-shaped section
31 Flat section
33 Embroidery material
35 Web
37 Rolled flange
39 Latch tab

The invention claimed is:

1. Embroidery hoop for a sewing or embroidery machine, comprising a lower hoop part (3) with a coupling element (7) for coupling the embroidery hoop (1) onto a drive part on the sewing or embroidery machine, an upper hoop part (5) that can be connected to the lower hoop part (3) by a hinge (9, 15), the hinge is formed by an elongate inner hinge element (9) and an elongate outer hinge element (15) that at least partially receives and encompasses the elongate inner hinge element (9) with an arc shape at an angle of 180°-240° to form a disengageable contact area of the hinge between the elongate inner and outer hinge elements, and the embroidery material can be inserted and clamped between the elongate inner and outer hinge elements (9, 15) at the disengageable contact area that forms the hinge.

2. Embroidery hoop according to claim 1, wherein the elongate inner hinge element (9) comprises a cylindrical rod (11) that is carried by a web (13) connected to a periphery of the rod (11) and the elongate outer hinge element (15) is formed by a concave-shaped end or outer edge of the upper hoop part (5).

3. Embroidery hoop according to claim 2, wherein a leg of the upper hoop part (5) opposite the elongate outer hinge element (15) also has a concave-shaped end or outer edge and a leg that lies opposite the hinge, and a rod (17) that can pivot about an axis extending parallel to the hinge, is arranged on the lower hoop part (3).

4. Embroidery hoop according to claim 3, wherein the rod (17) is carried by a web (19) set apart from the rotational axis.

5. Embroidery hoop according to claim 1, wherein fasteners or latch elements (23) mounted so that they can pivot are machined on the upper hoop part (3) for an additional securing of the latching of the lower hoop part (3) and upper hoop part (5).

6. Embroidery hoop according to claim 1, wherein the hinge is formed by a c-shaped spring plate (29) on the upper hoop part (5) and a latch tab (39) formed on the lower hoop part (3).

7. Embroidery hoop according to claim 6, wherein the spring plate (29) is attached to each of the straight edges or legs of the upper hoop part (5).

8. Embroidery hoop according to claim 6, wherein the spring plate (27) forms an upper hoop part (5), c-shaped sections (29) of the spring plate (27) are notched at corners of the upper hoop part (5).

9. Embroidery hoop according to claim 8, wherein the c-shaped section of the spring plate (27) comprises one or two rolled flanges (37, 37'), and the rolled flanges (37, 37') grip behind the latch tab (39) on one or two sides.

10. Embroidery hoop according to claim 9, wherein the latch tab (39) has a thicker edge region (39') on a side facing an entire region of the embroidery material (33).

* * * * *